United States Patent [19]

Harris

[11] Patent Number: 4,958,570

[45] Date of Patent: Sep. 25, 1990

[54] BULLET ASSEMBLY AND METHOD OF MAKING THE SAME

[76] Inventor: David A. Harris, 601 W. 6th St., Greenfield, Ind. 46140

[21] Appl. No.: 405,207

[22] Filed: Sep. 8, 1989

[51] Int. Cl.[5] ..... F42B 12/02; F42B 30/02

[52] U.S. Cl. ..... 102/517; 102/439; 102/524

[58] Field of Search ..... 102/473, 439, 448, 501, 102/507–510, 517, 519, 524, 525, 529, 514, 516

[56] References Cited

U.S. PATENT DOCUMENTS

| | | | |
|---|---|---|---|
| 394,673 | 12/1888 | Biscoff et al. | 102/514 |
| 549,334 | 11/1895 | Smith | 102/502 |
| 1,095,501 | 5/1914 | Hoagland | 102/509 |
| 1,135,357 | 4/1915 | Clyne | 102/508 |
| 1,248,656 | 12/1917 | Henry | 102/517 |
| 1,512,026 | 10/1924 | Holden et al. | 102/509 |
| 1,681,295 | 8/1928 | Johnson | 102/509 |
| 3,230,886 | 1/1966 | Woodring | 102/507 |
| 4,417,521 | 11/1983 | Dahlitz | 102/511 |
| 4,587,905 | 5/1986 | Maki | 102/439 |
| 4,610,205 | 9/1986 | Bently | 102/529 |
| 4,779,535 | 10/1988 | Maki | 102/501 |

FOREIGN PATENT DOCUMENTS

| | | | |
|---|---|---|---|
| 131225 | 6/1902 | Fed. Rep. of Germany | 102/507 |
| 737801 | 10/1943 | Fed. Rep. of Germany | 102/517 |
| 566 | of 1860 | United Kingdom | 102/529 |
| 2115118 | 9/1983 | United Kingdom | 102/529 |

*Primary Examiner*—David H. Brown
*Attorney, Agent, or Firm*—Barnes & Thornburg

[57] ABSTRACT

A bullet assembly includes a nose member having an outer cylindrical wall terminating at its forward end with a generally hemispherical nose. The nose member also includes an inner wall defining a concentric cavity inside the nose member having a predetermined axial depth. The bullet assembly also includes a base member having a cylindrical body portion and a projection that extends away from an upper surface of the body portion. The projection engages the inner wall of the nose member to secure the nose member to the base member. The projection has an axial length smaller than the predetermined depth of the cavity to form a hollow region completely disposed and enclosed inside the nose member.

7 Claims, 1 Drawing Sheet

BULLET ASSEMBLY AND METHOD OF MAKING THE SAME

BACKGROUND AND SUMMARY OF THE INVENTION

The present invention relates to a bullet assembly for use with muzzle-loading rifles or other type guns. More particularly, the present invention relates to a two-piece bullet assembly for producing a hollow nose bullet to cause a mushrooming effect and to increase the amount of hydrostatic shock waves produced when the bullet strikes a target.

Muzzle-loading rifles are widely used by hunters to hunt deer or other animals. A problem associated with muzzle-loading rifles is that the velocity of the bullets fired from the rifles is too slow to produce the hydrostatic shock waves necessary to humanely kill or instantly disable the animal that the bullet hits. Therefore, the wounded animal often escapes from the hunter to die later.

If the muzzle-loading rifle is loaded with enough powder to obtain the desired high velocity, lead from the bullet will melt and form deposits in the barrel of the rifle. After lead deposits build up inside the barrel, it is necessary to re-barrel the rifle which can be very expensive.

One object of the present invention is to provide a bullet assembly which produces a mushrooming effect and which increases the amount of hydrostatic shock waves produced at a low bullet velocity.

Another object of the present invention is to provide a bullet assembly that can be used with conventional muzzle-loading rifles without modifying the rifles.

Yet another object of the present invention is to provide a bullet assembly which has substantial penetrative power.

According to the present invention, a bullet assembly comprises a nose member including an outer cylindrical wall having a predetermined diameter terminating at its forward end with a nose. The nose member also has a rearward end and an inner wall defining a concentric cavity extending axially and forwardly from the rearward end. The cavity has a predetermined axial depth. The bullet assembly also includes a base member having a cylindrical body of the same diameter as said nose member outer cylindrical wall. A projection is situated on the cylindrical body of the base member and extends axially forward to be tightly received in the cavity. The projection has an axial length less than the axial depth of the cavity to provide a hollow nose cavity completely disposed and enclosed within the nose member.

In a preferred embodiment of the present invention, the projection has a truncated conical shape and extends concentrically and axially away from an upper surface of the cylindrical body of the base member to define an annular ledge on the base member. The nose member includes a concentric annular mating surface surrounding the cavity which abuts the annular ledge when the nose member and base member are joined together.

The inner wall of the nose member is equally spaced apart from the outer wall to provide a uniform thickness throughout the nose member. The uniform thickness of the nose member controls the degree of mushrooming when the bullet strikes a target. The nose of the nose member is generally hemispherically shaped. This shape of the nose prevents the deformation of the nose member when the bullet assembly is loaded into a muzzle-loading rifle by a cupped short starter.

One feature of the present invention is the provision of a hollow nose member formed to include a concentric cavity and a base member which is coupled to the nose member to provide a bullet assembly having a hollow nose cavity completely disposed and enclosed within the nose member. Advantageously, such a configuration provides a lighter weight bullet capable of traveling at higher velocities than conventional bullets with the same charge of powder. In addition, the nose member of the bullet assembly of the present invention mushrooms at low velocity and fragments at high velocity to provide hydrostatic shock waves at both high and low bullet velocities.

Another feature of the present invention is the provision of a tapered projection extending from the base member of the bullet to engage the cavity of the nose member. This locking taper prevents the bullet assembly from coming apart until the bullet hits the target. At low velocities, the nose member remains intact on the base member and mushrooms outwardly to produce a larger opening and increase the amount of hydrostatic shock produced when the bullet hits the target. At high velocities, the nose member will fragment and break away from the base member. The base member will then continue to penetrate into the target. Therefore, the bullet assembly of the present invention provides an improvement over conventional bullets in the amount of hydrostatic shock produced without substantially sacrificing penetrative power.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed, description particularly refers to the accompanying figures in which.

DETAILED DESCRIPTION OF THE DRAWINGS

Figure 1:
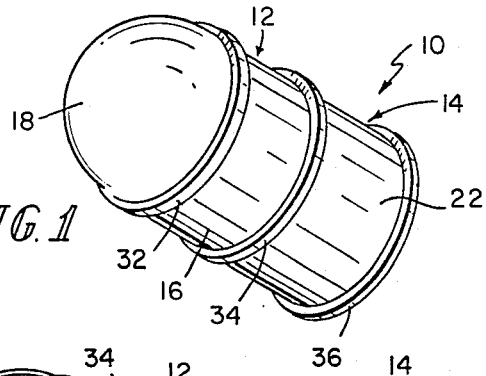
FIG. 1 is a perspective view of the bullet assembly of the present invention.
Figure 2:
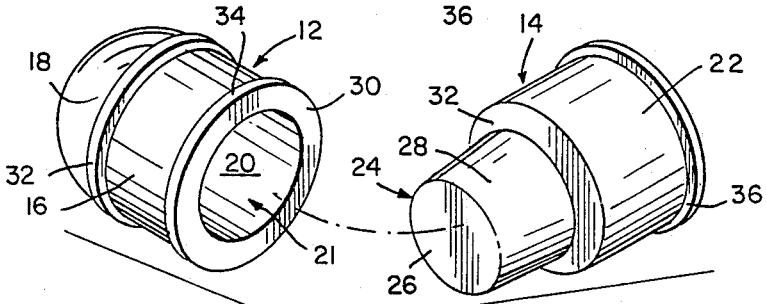
FIG. 2 is an exploded perspective view of the bullet assembly illustrating the nose member and base member.

Referring now to the drawings, and particularly to FIGS. 1 and 2, a bullet assembly 10 includes a nose member 12 and a base member 14. Nose member 12 includes a generally cylindrical body portion 16 and a hemispherical nose 18 coupled to a forward end of body portion 16. The cylindrical body portion 16 has a predetermined diameter corresponding to the desired caliber of bullet 10.

Nose member 12 includes an inner wall 20 defining a cavity 21 having a predetermined axial depth inside the nose member 12. Nose member 12 is also formed to include a first driving band 32 and a second driving band 34. Driving bands 32 and 34 as well as driving band 36 on base member 14 increase the stability of the bullet as it is fired from the rifle. Driving bands 32, 34 and 36 are substantially evenly spaced along the outer surface of bullet 10 when nose member 12 and base member 14 are joined together.

Base member 14 includes a cylindrical body portion 22 having the same diameter as the cylindrical body portion 16 of nose member 12. Base member 14 also includes a projection 24 extending axially away from the body portion 22. The projection 24 has a top surface 26 and a side wall 28. Projection 24 has a truncated conical shape and is inserted into the cavity 21 of nose member 12 until side wall 28 of projection 24 engages the inner wall 20 of nose member 12.

Figure 3:
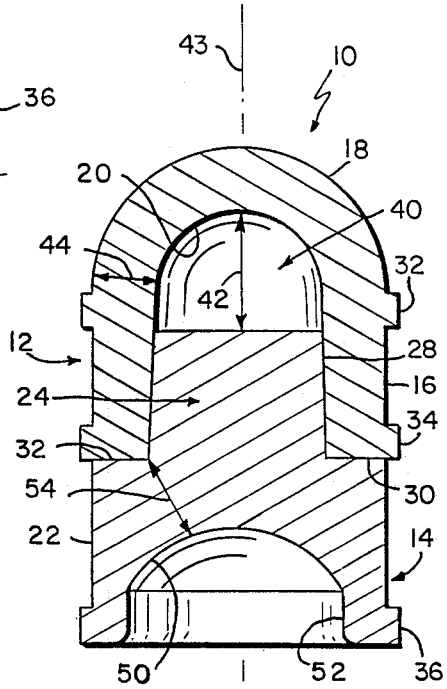
FIG. 3 is a transverse sectional view taken along the longitudinal axis of the bullet assembly.

The projection 24 has an axial length less than the predetermined axial depth of the cavity 21 to provide a hollow region 40 inside the bullet 10 when the nose member 12 and base member 14 are joined together as best shown in FIG. 3. Hollow region 40 is defined by upper surface 26 of projection 24 and a portion of the inner wall 20 of nose member 12. The hollow region 40 is completely disposed and enclosed within the nose member 12. Side wall 28 of projection 24 is slightly tapered so that side wall 28 can be inserted into cavity 21 to tightly engage the inner wall 20 of nose member 12.

Inner wall 20 is equally spaced from the outer surface of the body portion 16 and nose 18 of nose member 12 to provide a substantial uniform thickness throughout the nose member 12 as illustrated by dimension 44. Therefore, nose member 12 has a substantially U-shaped cross-section taken through longitudinal axis 43. The maximum distance from the inner wall 20 to the upper surface 26 of projection 24 inside hollow region 40 as illustrated by dimension 42 is at least 1.5 times the thickness 44 of nose member 12. Upper surface 26 of projection 24 lies in a plane which is transverse to the longitudinal axis 43 of bullet assembly 10. The configuration of upper surface 26 as well as the uniform thickness 44 of the nose member 12 prevents the nose member 12 from mushrooming too fast upon impact with the target.

Projection 24 extends concentrically and axially away from an upper surface of body portion 22 to define an annular ledge 32 on base member 14. Nose member 12 includes a concentric annular mating surface 30 which surrounds cavity 21. Mating surface 30 abuts annular ledge 32 when the nose member 12 and base member 14 are joined together to form the bullet assembly 10.

Base member 14 is formed to include a substantially hemispherically shaped concave bottom surface 50. Bottom surface 50 is surrounded by an annular flange 52. When the bullet assembly 10 is fired from the barrel of a rifle, the concave bottom surface 50 evenly distributes the pressure from the charge to prevent a portion of annular flange 52 from becoming deformed which would reduce the accuracy of the bullet assembly 10.

Annular flange 52 expands outwardly when the gun is fired to seal the barrel of the gun and increase the spin and velocity of the bullet assembly 10. The minimum distance from the bottom surface 50 to the mating surface 30 of nose member 12 as illustrated by dimension 54 must be large enough to prevent the explosion from driving the projection 24 further into the nose cavity 21 of nose member 12.

The bullet assembly 10 of the present invention is preferably formed from lead but may be formed of any other suitable material. Several steps are required to manufacture the bullet assembly 10 according to the present invention. The nose member 12 and base member 14 are cast or molded in two separate operations. The outer wall of nose member 12 which includes the cylindrical body 16 and nose 18 is formed inside a mold having a predetermined diameter. A nose plunger having dimensions equal to the dimensions of cavity 21 of nose member 12 is then forced into the nose mold to stamp the cavity 21 inside nose member 12.

Lead is then poured into a base mold which forms the outer shape of base member 14 including body portion 22 and projection 24. A base plunger having the shape of concave bottom surface 50 and annular flange 52 is then forced into the base mold to form bottom surface 50 and flange 52 in base member 14. The projection 24 of base member 14 is then inserted into the cavity 21 of nose member 12 until projection 24 engages the inner wall 20 of nose member 12 to secure the nose member 12 and base member 14 together to form the bullet assembly 10. The bullet assembly 10 can then be forced through a resizer to produce the desired caliber of bullet to fit the bore diameter of a rifle properly.

Figure 4:
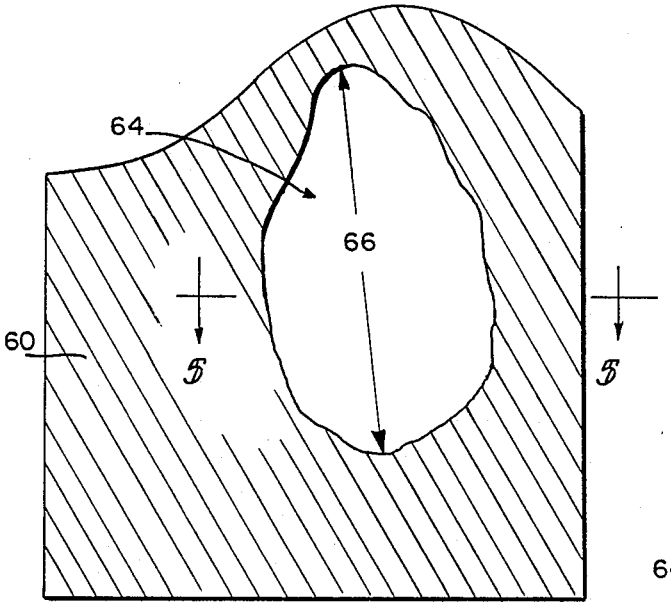
FIG. 4 is a dead sectional view of test results obtained from firing the bullet assembly of the present invention taken transverse to the direction of travel of the bullet along lines 4—4 of FIG. 5.
Figure 5:
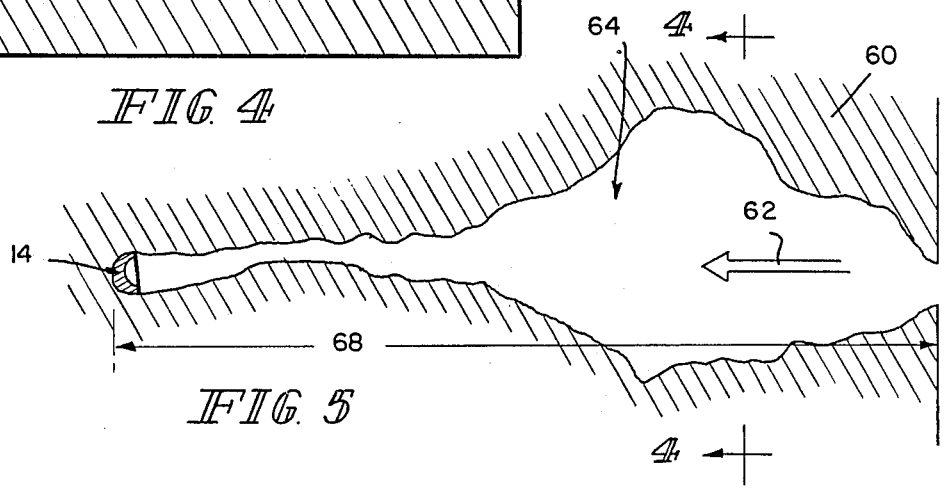
FIG. 5 is a dead sectional view taken along lines 5—5 of FIG. 4 further illustrating the test results obtained using the bullet assembly of the present invention.

FIGS. 4 and 5 illustrate test results obtained using the bullet assembly 10 constructed as shown in FIGS. 1–3. The bullet 10 used for this test was a .50 caliber bullet. 100 grains of 3-F black powder were used in the rifle. The bullet was fired from a distance of 25 yards away into a test substance 60 comprising 30% motor oil (30W) and 70% beeswax. The bullet 10 was fired in the direction illustrated by arrow 62 in FIG. 5 and created a cavity 64 inside the test substance 60. The cavity 64 had a maximum width of about 5.25 inches as illustrated by dimension 66 in FIG. 4. The base member 14 of bullet 10 had a maximum penetration of about 9.75 inches as illustrated by dimension 68 in FIG. 5.

The bullet 10 of the present invention was compared with a Buffalo Bullet manufactured by the Buffalo Bullet Company of Whittier, Calif. When a .50 caliber hollow-point Buffalo Bullet was fired into the same test substance 60 at the same distance and charge, the Buffalo Bullet created a cavity having a maximum width of about 3 inches and a maximum penetration of about 14 inches.

The bullet 10 according to the present invention creates a greater hydrostatic shock and a larger width cavity inside the target than conventional bullets. At low velocities, the nose member 12 and base member 14 remain intact and the nose member 12 mushrooms to provide increased hydrostatic shock and produce a jagged laceration inside the target. At high velocities, the nose member 12 will fragment and break away from base member 14. The base member 14 will then continue to penetrate through the target.

Although the invention has been described in detail with reference to a preferred embodiment, variations and modifications exist within the scope and spirit of the invention as described and defined in the following claims.

What is claimed is:

1. A bullet assembly comprising a two piece projectile consisting of:

a hollow cylindrical nose member having an outer and inner surface defining a hollow generally cylindrical body portion and a hemispherical end nose portion wherein a cross-section of the hollow cylindrical nose member defines a substantially U-shape with the hemispherical nose portion forming a bight of the U-shape cross-section;

a solid base member having a cylindrical body portion with an outer surface of equal diameter to a diameter of the outer surface of the cylindrical nose member and a tapered solid projection portion which is located within a cavity defined by the hollow in the generally cylindrical body portion of the nose member;

wherein the nose and base members are made from the same material;

wherein the solid projection portion of the base member is axially separated from the inner surface of the hemispherical end of the nose member to define a hollow region between the solid projection and the inner surface of the hemispherical end of the nose member;

wherein the inner surface of the cylindrical body portion of the nose member has a substantial identical taper with the taper of the solid projection so as to provide a tight fit therebetween;

wherein the solid projection is axially centered on the solid base member with its taper being axially inwardly displaced from the outer diameters of the outer surfaces of the nose and base members;

wherein an open end of the nose member abuts a flat annular ledge on the base member that extends between the taper of the projection and the outer surface of the base member to provide a close fit therebetween; and wherein a thickness between the inner and outer surfaces of the hemispherical end nose portion of the nose member at the hollow region is substantially constant.

2. The assembly of claim 1, wherein the maximum distance from the inner wall to the projection in the hollow region is at least 1.5 times the thickness of the nose member.

3. The assembly of claim 1, wherein a top surface of the projection is aligned in a plane substantially transverse to the longitudinal axis of the bullet to control the amount of mushrooming of the nose member when the nose member strikes a target.

4. The assembly of claim 1, wherein the base member includes a concave bottom surface.

5. The assembly of claim 4, wherein the base member is formed to include an annular flange surrounding the concave bottom surface to expand and seal a barrel of a gun when the gun is fired.

6. The assembly of claim 1, further comprising at least three driving bands selectively formed on the nose member and base member.

7. The assembly of claim 6, wherein the nose member is formed to include two driving bands and the base member is formed to include a third driving band, the driving bands being substantially evenly spaced along the outer surface of the bullet when the nose member and base member are interconnected.

* * * * *